US005689240A

United States Patent [19]

Traxler

[11] Patent Number: 5,689,240

[45] Date of Patent: Nov. 18, 1997

[54] CHILD MONITOR SYSTEM

[75] Inventor: Norbert B. Traxler, Prior Lake, Minn.

[73] Assignee: C.O.P. Corp., Mankato, Minn.

[21] Appl. No.: 658,708

[22] Filed: Jun. 5, 1996

[51] Int. Cl.[6] ..... G08B 23/00

[52] U.S. Cl. ..... 340/573; 340/539; 340/572; 340/991; 342/450

[58] Field of Search ..... 340/539, 573, 340/825.69, 525, 991, 572; 455/51.1, 38.3, 70; 342/357, 450

[56] References Cited

U.S. PATENT DOCUMENTS

| | | | |
|---|---|---|---|
| 4,331,953 | 5/1982 | Blevins et al. | 340/573 |
| 4,593,273 | 6/1986 | Narcisse | 340/539 |
| 4,675,656 | 6/1987 | Narcisse | 340/539 |
| 4,785,291 | 11/1988 | Hawthorne | 340/573 |
| 5,021,794 | 6/1991 | Lawrence | 342/457 |
| 5,047,750 | 9/1991 | Hector | 340/573 |
| 5,115,223 | 5/1992 | Moody | 340/539 |
| 5,119,072 | 6/1992 | Hemingway | 340/573 |
| 5,245,314 | 9/1993 | Kah, Jr. | 340/539 |
| 5,289,163 | 2/1994 | Perez et al. | 340/539 |
| 5,337,041 | 8/1994 | Friedman | 340/573 |
| 5,357,254 | 10/1994 | Kah, Jr. | 340/539 |
| 5,448,221 | 9/1995 | Weller | 340/539 |
| 5,461,365 | 10/1995 | Schlager et al. | 340/573 |
| 5,477,210 | 12/1995 | Belcher | 340/573 |
| 5,490,286 | 2/1996 | Kah, Jr. | 340/539 |
| 5,525,967 | 6/1996 | Azizi et al. | 340/539 |
| 5,526,357 | 6/1996 | Jandrell | 340/991 |

*Primary Examiner*—Brent A. Swarthout
*Assistant Examiner*—Van T. Trieu
*Attorney, Agent, or Firm*—Haugen and Nikolai P.A.

[57] ABSTRACT

A system that transmits and receives signals comprising a master unit and a remote unit, wherein a separation distance between the master unit and remote unit is continuously monitored and an alarm is activated on the master unit when no signal is received from the remote unit for at least a time longer than a preset interval. If the separation distance between the master and remote unit is exceeded for a time longer than a preset time interval, the remote unit activates an alarm attached to the remote unit. The master unit may also be used to activate manually the remote unit's alarm. A pin or key arrangement is provided that ensures that the remote unit is not deactivated without interfacing with the master unit.

8 Claims, 4 Drawing Sheets

CHILD MONITOR SYSTEM

BACKGROUND OF THE INVENTION

I. Field of the Invention

This invention relates generally to personal proximity monitoring systems, and more particularly to an RF-based system that monitors predetermined separation limits between two units relative to the other. Independent alarms associated with each unit are programmed to activate in a particular sequence when the distance between the units exceeds the predetermined range for a time greater than a preset interval.

II. Discussion of the Related Art

The safety and whereabouts of a child relative to a parent or other supervising individual in various surroundings has become an increasing concern. Over the years, monitoring or locating systems have been developed to monitor the location or proximity of a child or other object of interest. Oftentimes, an inquisitive child will stray out of sight of the guardian or parent, particularly in crowded areas such as shopping malls, and unless the child is continuously watched or monitored, the guardian may not know where to begin to look for the child. When the child remains unwatched, of course the threat of the child becoming separated, lost for a time, or even being kidnaped or otherwise lured away against the will of the guardian increases. Unfortunately, as a practical matter, little else can be accomplished if a guardian is required to continuously watch the child. Therefore, it is desirable, in these instances, to provide an alternate system to be able to locate the child quickly.

Personal alarm and monitor systems are gaining increased popularity as locators and means of monitoring children's activities. For example, in U.S. Pat. No. 5,461,365 to Schlager et al.; U.S. Pat. No. 5,357,254 to Kah Jr. and U.S. Pat. No. 4,785,291 to Hawthorne disclose monitoring systems which may be used to warn a guardian when a predetermined range between a transmitter and receiver has been exceeded.

Kah Jr. discloses a location monitoring system including a transmitting and a receiving device, in which the transmitting device is worn by a person or object to be monitored. The receiving device (controlled by the guardian) includes an alarm which is actuated when the transmitter device has exceeded a predetermined range.

Hawthorne discloses a child surveillance distance monitor including a transmitter and a receiver. The child wears the transmitter and the guardian operates the receiver. The guardian's receiver includes a programmed electronic circuit that actuates any of several electrically coupled alarms depending upon the relative separation distance between the transmitter and receiver.

Likewise, Schlager et al. discloses a monitoring system including a base station and a remote unit. The remote unit is associated with the child and, in one embodiment, includes an alarm which may be activated by depressing a panic button or by sending an activation signal from the base station. Only the base station includes an alarm that is activated when the remote unit exceeds the separation distance limit from the base unit. In each case, the unit to be worn by the child does not independently determine that the predetermined range has been exceeded, thereby actuating an alarm.

Current monitoring systems do not automatically trigger alarms on both the unit worn by the child and the unit retained by the guardian. The independent activation of an alarm on the remote unit identifies a specific child and may alert bystanders near the child that the child is out of range of the guardian, even when the guardian is out of audible range. Therefore, a need exists for a monitoring system that both alerts the parent that the child has strayed beyond a preset distance and also transmits an alarm from the child's unit indicating to bystanders that the child has strayed from the guardian beyond the preset distance. The present invention addresses these and other disadvantages of the prior art.

SUMMARY OF THE INVENTION

The purpose of the present invention is to provide a monitoring system that both alerts a guardian when a child has strayed more than a predetermined distance from the guardian for a given length of time and thereafter further independently actuates an alarm carried by the child. The monitoring system of the present invention includes a master unit and one or more remote or slave units, each of which generally include a transmitter, receiver and alarm coupled to an associated electronic circuit. The master unit is operated by the guardian or user and each remote unit is attached to a child or other object to be monitored.

In one embodiment, the master and remote units are initialized by depressing an on-off switch located on a side of each respective unit. To activate the units, a key or pin having a predetermined shape is then removed from the remote unit and inserted into a slot of the master unit, having a corresponding matching configured shape, thereby activating the remote and master units. The remote unit is de-activated by removing the key from the master unit and re-inserting the key into the corresponding receptacle of the remote unit.

Once the system is activated, the master unit transmits an encoded radio frequency (rf) signal to the remote unit. When the two units are in close proximity to each other, the transmitted rf signal is received by the remote unit, the remote unit then transmits a corresponding encoded rf signal to the master unit. This reception and transmission or "handshaking" of encoded rf signals continues unless the corresponding rf signal becomes too weak for the remote or master unit to detect.

If, however, for any reason the master unit has not received an encoded signal from the remote unit for more than a preset period of time, an alarm electrically coupled to the master unit is activated. Likewise, after a preset time if the remote unit has not received an encoded signal from the master unit, an alarm electrically coupled to the remote unit is activated. The sensitivity of the receiver and amplitude of the encoded rf signals for the respective master and remote units is adjustable, thereby in effect allowing adjustment of the separation distance between the master and remote unit before either alarm is activated. Those skilled in the art will appreciate that the preset time interval for the master unit may be adjustable and/or less than the time interval for the remote unit, thereby allowing the guardian some time to re-establish contact before the remote alarm is activated.

The master unit includes a switch that, when activated, sends an encoded "find" signal to the remote unit. Once the remote unit receives the encoded "find" signal, the remote unit emits a chirping or other type audible alarm until the master unit's "find" switch is deactivated. The master unit also includes a button that, when activated, sends an encoded signal to the remote unit which automatically activates the alarm on the remote unit.

The remote unit may include a securing strap coupled to its electric circuit, wherein the remote unit's alarm is activated if the securing strap is detached prior to de-activation of the remote unit. In this manner, the remote unit is not removable without either activating the alarm of the remote unit or being de-activated with the corresponding key. Those skilled in the art will appreciate that the remote unit may be programmed such that the chirping type audible signal automatically activates when the remote unit has not received an encoded signal from the master unit for more than a preset period of time.

OBJECTS

It is accordingly a principal object of the present invention to provide a monitoring system that includes a master and remote unit each of which independently emit an alarm if the units are separated too far for too long, wherein the separation distance limits and timing interval of the master and remote units are adjustable.

Another object of the present invention is to provide a remote unit of a monitoring system that can not be de-activated without a corresponding key.

Yet another object of the present invention is to provide a remote unit of a monitoring system having a security strap for attachment around the selected object or child, wherein the remote unit will activate its alarm if the security strap is removed prior to deactivating the remote unit.

A further object of the present invention is to provide a monitoring system including master and remote units, wherein the master unit includes a panic button that when activated, actuates the remote unit's alarm.

Still a further object of the present invention is to provide a monitoring system including master and remote units, wherein the master unit includes a find switch that, when activated, actuates an alarm from the remote unit.

These and other objects, as well as these and other features and advantages of the present invention will become readily apparent to those skilled in the art from a review of the following detailed description of the preferred embodiment in conjunction with the accompanying claims and drawings in which like numerals in the several views refer to corresponding parts.

DETAILED DESCRIPTION

Figure 2:
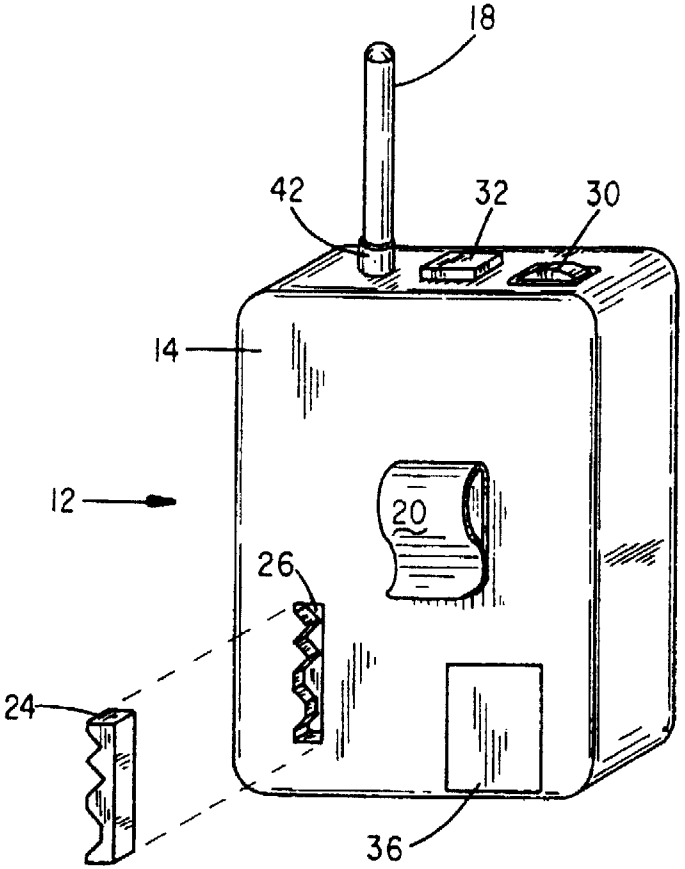
FIG. 2 is a back perspective view of the master unit of the type shown in FIG. 1.
Figure 1:
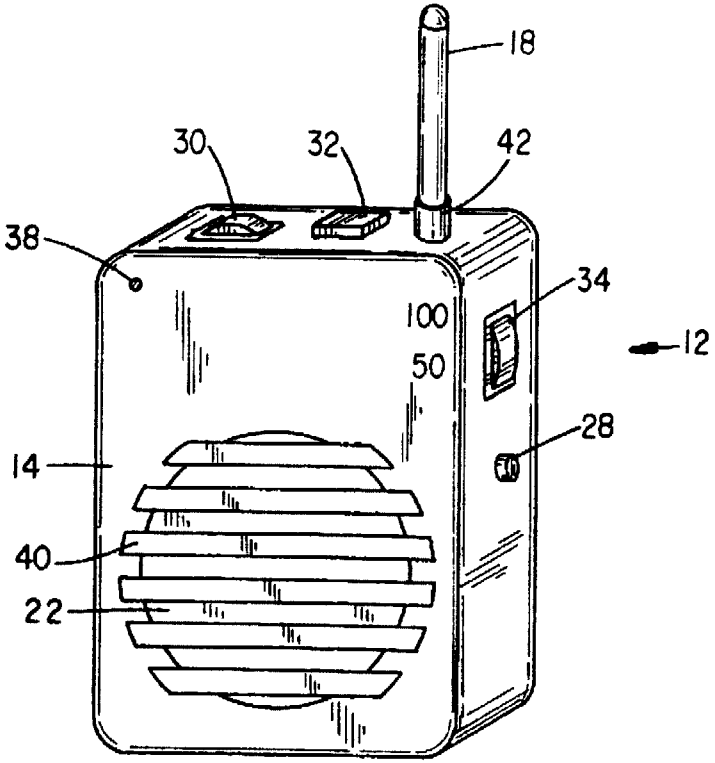
FIG. 1 is a front perspective view of a master unit of the monitor system of the present invention.

In conjunction with the several views of the figures, details of representative embodiments will next be presented. Referring first to FIGS. 1 and 2, there is shown, generally, the master unit 12 of the monitoring system of the present invention. The master unit 12 includes a housing 14, antenna 18, belt clip 20, speaker 22, key 24, key receptacle 26, on/off switch 28, find switch 30, panic button 32, signal amplitude switch 34, battery compartment 36, and low battery LED 38. An electric circuit 16 for the unit is shown schematically in FIG. 5.

The housing 14 is preferably constructed from a durable polymer and includes a hollow central portion, wherein the electronic circuitry 16 and associated devices are contained. The belt clip 20 is attached to an external side of the housing 14. A key receptacle 26 having a predetermined geometric shape is molded into an external surface of the housing 14. Electrical contacts of known construction are positioned within the key receptacle 26 and electrically coupled to the electronic circuit 16. The key 24 closes the circuit between the electrical contacts of the key receptacle 26, when the key 24 is properly aligned and engaged within the key receptacle 26. The on/off switch 28, find switch 30, panic button 32, and rf signal amplitude switch 34 are each mounted in the housing 14. Each of the switches 28, 30, 32, and 34 are electrically coupled to the electronic circuit 16. Additionally, a battery compartment 36 is formed in the back side of the housing 14. Electrical leads, of known construction for attachment to a battery, extend from the electronic circuit 16 into the battery compartment 36. The battery may be a rechargeable unit and a charging circuit input (not shown) may also be provided for recharging the battery in a well known manner.

Formed within a front side of the housing 14 are a plurality of open slots 40 which extend from an outer surface to the hollow central portion of the housing 14. A speaker 22 is coupled to the electronic circuit 16 and aligned behind the slots 40, whereby the sound produced by the speaker 22 passes through the slots 40 and is emitted from the housing 14. A coupling 42 is molded within the housing 14 and is electrically coupled to the electronic circuit 16. The coupling 42 is adapted for receiving antenna 18 and transmits the signals received by the antenna 18 to the electronic circuit 16.

Figure 3:
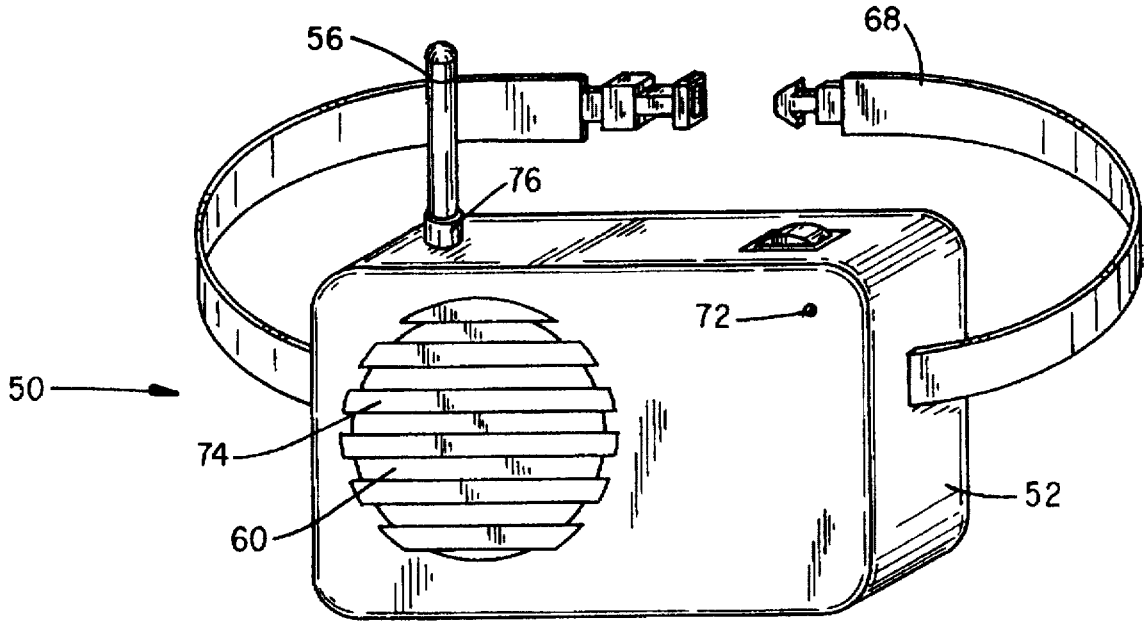
FIG. 3 is a front perspective view of a remote unit of the monitor system of the present invention.
Figure 4:
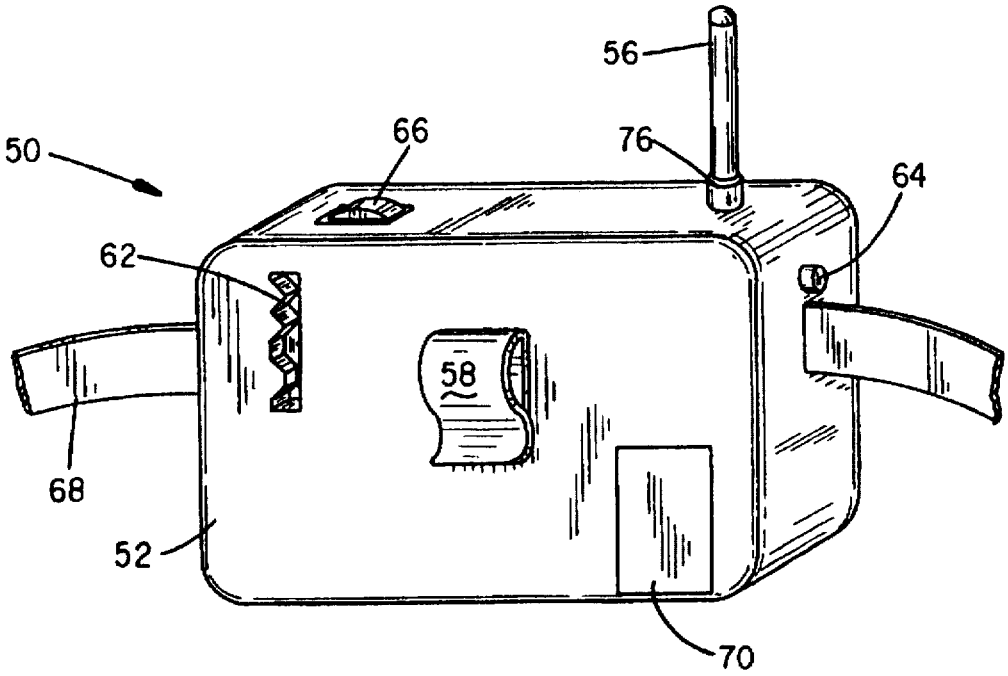
FIG. 4 is a back perspective view of the remote unit of the type shown in FIG. 3.

FIGS. 3 and 4, show generally a remote unit 50 for use with the monitoring system of the present invention. The remote unit 50 includes a housing 52, electronic circuit 54 (shown in FIG. 6), antenna 56, belt clip 58, speaker 60, key receptacle 62, on/off switch 64, signal amplitude switch 66, security strap 68, battery compartment 70, and low battery LED 72.

The housing 52 is preferably constructed from a durable polymer and includes a hollow central portion, wherein the electronic circuitry 54 and associated devices are contained. The belt clip 58 is attached to an external side of the housing 52. The key receptacle 62 having a shape corresponding to the master unit's 12 key receptacle 26 is molded into an external surface of the housing 52. Electrical contacts of known construction are positioned within the key receptacle 62 and electrically coupled to the electronic circuit 54. The key 24 closes the circuit between the electrical contacts of the key receptacle 62, when the key 24 is properly aligned and engaged with the key receptacle 62. The on/off switch 64 and rf signal amplitude switch 66 are each disposed in a respective conduit extending from an outer surface of the housing 52 into the hollow central portion of the housing 52. Each of the switches 64 and 66 are electrically coupled to the electronic circuit 54. Additionally, a battery compartment 70 is formed in the back side of the housing 52. Electrical leads, of known construction for attachment to a battery, extend from the electronic circuit 54 into the battery compartment 70. As with the master unit, a rechargeable power supply may be used.

A plurality of speaker slots 74 are formed within a front side of the housing 52, wherein the slots 74 extend from an outer surface to the hollow central portion of the housing 52. The speaker 60 is aligned behind the slots 74. A coupling 76 is molded within the housing 52 and is electrically coupled to the electronic circuit 54. The coupling 76 is adapted for receiving antenna 56 and transmits the signals received by the antenna 56 to the electronic circuit 54.

Figure 5:
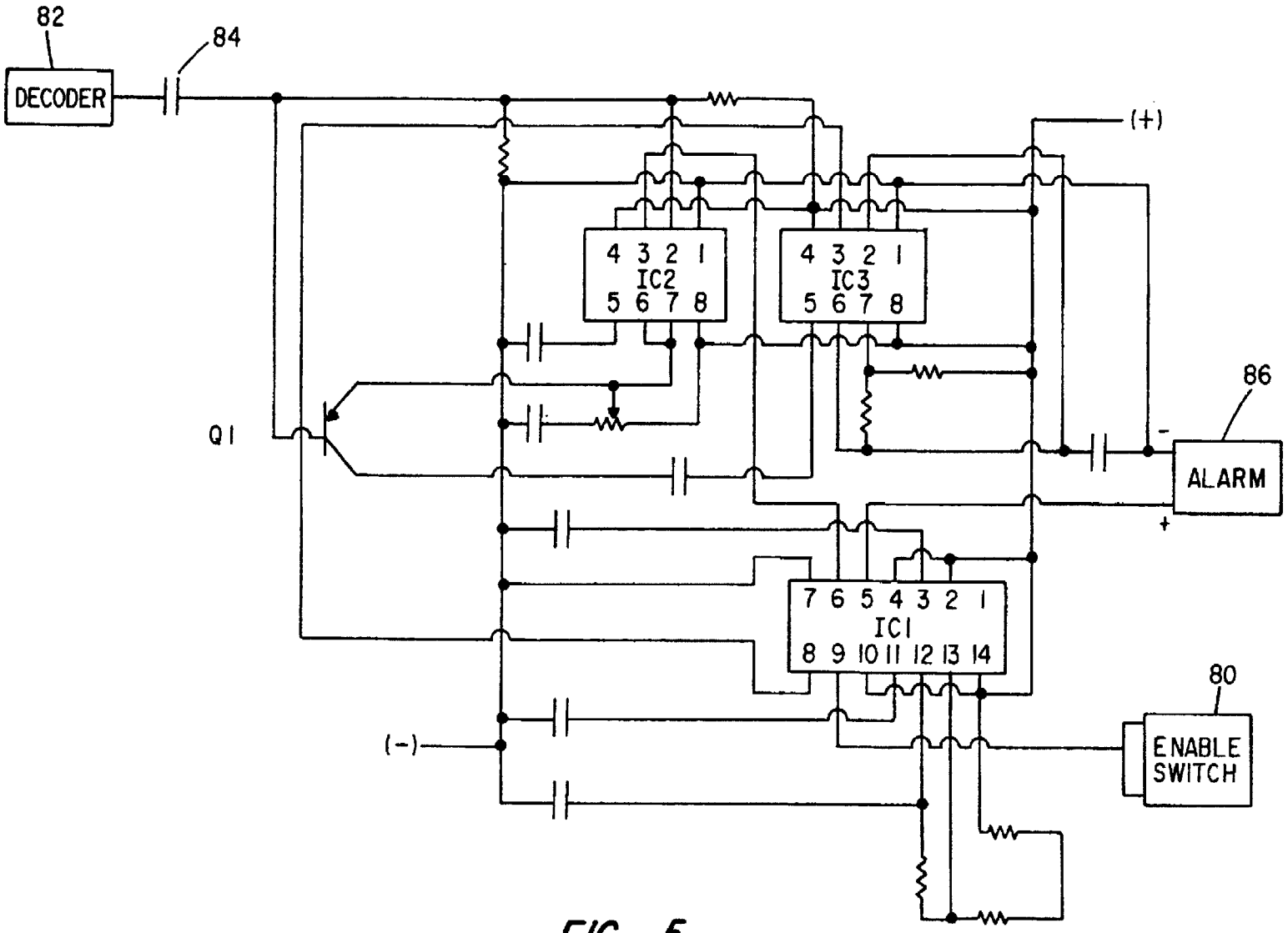
FIG. 5 is a schematic diagram of an electric circuit used in the master unit of the monitor system of the present invention.

FIG. 5 depicts a portion of the electronic circuit 16 of the master unit 12 including the portion that actuates the alarm. The portion of the circuit board shown in FIG. 5 includes a monitor timer IC2, transmitter control oscillator IC3, transmitter pulser IC1 (pin 9), and buzzer flip-flop IC1 (pin 5). A control oscillator IC3 is electrically coupled to the transmitter and enables the transmitter by periodically triggering the transmitter pulser IC1. The enable switch 80 is electrically coupled to the rf transmitter. A decoder 82 is electrically coupled to the rf receiver (not shown) which detects the digitally encoded signal from the remote unit 50. Each time a matching code is received and decoded, a positive going pulse is transmitted to IC1 (pin 13). The monitor timer input IC2 is connected to the decoder via a capacitor 84. The capacitor 84 differentiates the pulse decoder 82 to provide a negative going pulse to trigger the monitor timer IC2. The monitor timer IC2 is triggered by receiving a coded pulse from the remote unit 50 and re-triggered via the transistor Q1 each time a new matching encoded signal is received. If a matching code is not received after a preset time interval, for example ten seconds, the monitor timer IC2 low triggers the flip flop in IC1. The flip flop IC1 enables a piezoelectric audible alarm 86. The audible alarm continues to sound until the unit is deactivated or a properly encoded rf signal is detected.

Figure 6:
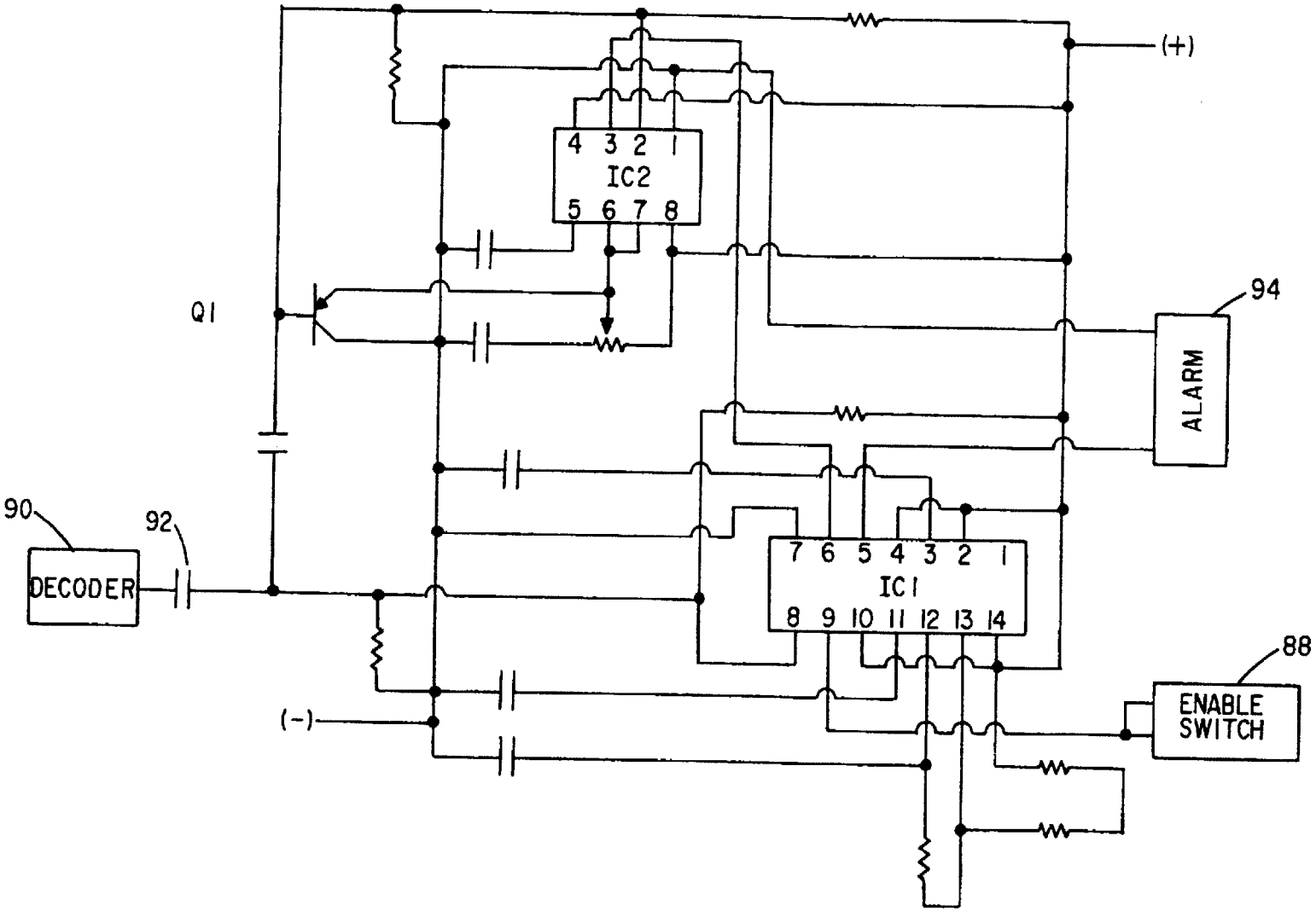
FIG. 6 is a schematic diagram of an electric circuit used in the remote unit of the monitor system of the present invention.

The portion of the electrical circuitry of remote unit 50 that actuates the alarm is shown in FIG. 6. The portion of the circuit board shown in FIG. 6 includes a monitor timer IC2, transmitter enable pulser IC1 (pin 9), and buzzer flip-flop IC1 (pin 5). An enable switch 88 is electrically coupled to the rf transmitter. A pulse decoder 90 is electrically coupled to the rf receiver (not shown) which detects the digitally encoded signal from the master unit 12. Each time a matching code is received and decoded, a pulse is transmitted to IC1 (pin 13). The monitor timer input IC2 is connected to the decoder via a capacitor 92. The capacitor 92 differentiates the pulse decoder 90 to provide a negative going pulse to trigger the monitor timer IC2 and the transmitter pulser IC1 (pin 8). The monitor timer IC2 is triggered by receiving a matching coded pulse from the master unit 12 and is re-triggered via the transistor Q1 each time a new matching encoded signal is received. If a matching code is not received after a preset time interval, the monitor timer IC2 low triggers the flip flop in IC1. The flip flop IC1 enables a piezoelectric audible alarm 94. The audible alarm 94 continues to sound until the unit is deactivated or a properly encoded rf signal is detected, thereby triggering the monitor timer. Those skilled in the art will appreciate that an interference filter of known construction may need to be adapted within the electronic circuitry in a known manner.

Having described the functional features of one embodiment of the present invention, the mode of use will now be discussed. For illustrative purposes, without any limitation intended, use of the monitoring system will be described, wherein the remote unit 50 is secured to a child and the guardian operates the master unit 12. The system including master unit 12 and remote unit 50 are initialized by depressing on-off switches 28 and 64 respectively. Removal of the key 24 from the remote unit 50 activates the remote unit. Insertion of the key 24 into slot 26 of the master unit 12, activates the master unit. The remote unit 50 can only be de-activated by removing the key 24 from the master unit 12 and inserting the key 24 into the corresponding receptacle 62 of the remote unit 50.

Once activated, the master unit 12 transmits an encoded radio frequency (rf) signal. The receiving unit 50 secured to the child receives and decodes rf signals. If the rf signal received by the remote unit 50 matches the encoded signal, the remote unit 50 then transmits a corresponding encoded rf signal for reception by the master unit 12. This "handshaking" of encoded rf signals continues unless the corresponding rf signal becomes too weak for the remote or master units 50 and 12 respectively to detect.

After a preset period of time, if the master unit 12 has not received an encoded signal from the remote unit 50 an alarm 86 electrically coupled to the master unit 12 is activated. Likewise, after a preset time if the remote unit 50 has not received an encoded signal from the master unit 12, an alarm 94 electrically coupled to the remote unit 50 is activated. The sensitivity of the receiver and amplitude of the encoded rf signals for the respective master and remote units is adjustable, thereby in effect allowing adjustment of the separation distance between the master and remote unit 12 and 50 respectively, before either alarm is activated.

At times the guardian may not be able to see the child, even though the alarm has not been activated. In such an instance the guardian may activate a "find" switch 30 which transmits an encoded "find" signal to the remote unit. Once the remote unit 50 receives the encoded "find" signal, the remote signal 50 emits a chirping type audible alarm until the master unit's 12 "find" switch 30 is deactivated. The master unit 12 also includes a button 32 that allows the guardian to activate the alarm on the remote unit 50.

The securing strap 68, coupled to the remote unit 50, allows the remote unit to be secured to the child, whereby the remote unit's alarm is activated if the securing strap is cut or detached prior to de-activation of the remote unit 50. In this manner, the remote unit 50 is not removable from the child without either activating the remote unit's alarm or being de-activated with the corresponding key 24. Those skilled in the art will appreciate that the master and remote units may take on any of several shapes and sizes to thereby accommodate various alternative mounting methods including mounting on the wrist, waist or neck.

This invention has been described herein in considerable detail in order to comply with the patent statutes and to provide those skilled in the art with the information needed to apply the novel principles and to construct and use such specialized components as are required. However, it is to be understood that the invention can be carried out by specifically different devices, and that various modifications, both as to the equipment details and operating procedures, can be accomplished without departing from the scope of the invention itself.

What is claimed is:

1. A child monitoring system adapted to activate an alarm when the child strays from the supervisor, comprising:

(a) a master unit including a power supply, first alarm means for emitting an audible alarm, transmitting means for transmitting a first encoded signal, and detecting means for detecting a second encoded signal all of which are electrically coupled to an electronic circuit contained within said master unit;

(b) a remote unit including a power supply, second alarm means for emitting an audible alarm, transmitting means for transmitting the second encoded signal, and detecting means for detecting the first encoded signal, whereby the first alarm means is activated when the master unit fails to receive the second encoded signal for more than a first predetermined time interval and the second alarm means is activated when the remote unit fails to receive the first encoded signal for more than a second predetermined time interval;

(c) key means electrically coupled to said remote unit, wherein the transmitting means of the second encoded signal is activated when the key means is removed from the remote unit and (d) wherein the transmitting means of the first encoded signal is activated when the key means is inserted into a corresponding receptacle of the master unit.

2. The child monitoring system according to claim 1, further comprising securing means electrically coupled to said remote unit for attaching the remote unit to the child.

3. The child monitoring system according to claim 2, wherein said securing means is coupled to said second alarm means, whereby said second alarm means is activated if the securing means is detached prior to inserting the key into a key receptacle of the remote unit.

4. A child monitoring system according to claim 1 wherein at least one of said first and second predetermined time intervals is adjustable.

5. A child monitoring system according to claim 4 wherein both the first and second predetermined time intervals are adjustable.

6. A child monitoring system according to claim 5 wherein a distance over which the master unit and the remote unit can receive encoded signals from each other is adjustable.

7. A child monitoring system according to claim 4 wherein a distance over which the master unit and the remote unit can receive encoded signals from each other is adjustable.

8. A child monitoring system according to claim 1 wherein a distance over which the master unit and the remote unit can receive encoded signals from each other is adjustable.

* * * * *